United States Patent [19]

Chappell

[11] Patent Number: 4,958,803

[45] Date of Patent: Sep. 25, 1990

[54] AUTOMATIC FLUID VALVE

[76] Inventor: Gilmore H. Chappell, 407 S. Almonesson Rd., Depford, N.J. 08096

[21] Appl. No.: 307,004

[22] Filed: Feb. 6, 1989

Related U.S. Application Data

[63] Continuation-in-part of Ser. No. 97,132, Sep. 16, 1987, abandoned, and a continuation-in-part of Ser. No. 263,958, Oct. 26, 1988, Pat. No. 4,895,468, which is a continuation of Ser. No. 45,323, May 4, 1987, abandoned, and a continuation-in-part of Ser. No. 282,987, Dec. 2, 1988, abandoned, which is a continuation of Ser. No. 165,636, Mar. 8, 1988, abandoned, and a continuation-in-part of Ser. No. 163,066, Mar. 2, 1988, abandoned, and a continuation-in-part of Ser. No. 163,065, Mar. 2, 1988, Pat. No. 4,361,156.

[51] Int. Cl.[5] ..... F16K 51/00

[52] U.S. Cl. ..... 251/342; 251/349

[58] Field of Search ..... 251/342, 349, 354, 149.8

[56] References Cited

U.S. PATENT DOCUMENTS

| | | | |
|---|---|---|---|
| Re. 308,491 | 1/1982 | Crist | 137/218 |
| 656,759 | 8/1900 | Wirt | 251/149.8 |
| 665,631 | 1/1901 | Duffus | 251/354 |
| 703,103 | 6/1902 | Weber | 251/354 |
| 1,181,594 | 5/1916 | Hinkle | 401/275 |
| 1,244,833 | 10/1917 | Burich | 251/149.8 |
| 1,372,125 | 3/1921 | Dreier | 251/149.8 |
| 1,510,898 | 10/1924 | Nikicser | 15/223 |
| 1,970,279 | 8/1934 | Creveling | 251/149.8 |
| 2,037,023 | 4/1936 | Holby | 137/152 |
| 2,133,147 | 8/1937 | Mortimore | 299/149 |
| 2,164,432 | 4/1939 | Selwyn | 15/128 |
| 2,234,386 | 3/1941 | Schaub et al. | 251/40 |
| 2,254,069 | 8/1941 | Harris | 137/152 |
| 2,441,704 | 5/1948 | Jackson | 251/149.8 |
| 2,456,687 | 12/1948 | Dominguez | 132/13.1 |
| 2,512,281 | 6/1950 | Loftstrand, Jr. | 251/115 |
| 2,525,615 | 10/1950 | Peck | 251/149.8 |
| 2,584,631 | 2/1952 | Soss | 299/84 |
| 2,683,886 | 7/1954 | Neumann | 15/115 |
| 2,785,016 | 3/1957 | Vollertzen et al. | 251/342 |
| 2,797,132 | 6/1957 | Alpert | 299/84 |
| 2,802,481 | 8/1957 | Jahn | 137/218 |
| 2,830,614 | 4/1958 | Pralle | 137/356 |
| 2,877,480 | 3/1959 | Warren | 15/127 |
| 2,922,425 | 1/1960 | Lerner et al. | 132/9 |
| 2,997,732 | 8/1961 | Gilchrist et al. | 15/598 |
| 3,016,605 | 1/1962 | Heckethorn | 29/453 |
| 3,107,861 | 10/1963 | Penkoff | 239/577 |
| 3,145,724 | 8/1964 | Pelzer | 137/217 |
| 3,183,934 | 5/1965 | Miner | 251/342 |
| 3,273,757 | 9/1966 | Moen | 222/185 |
| 3,357,604 | 12/1967 | Barker | 222/402.23 |
| 3,476,105 | 11/1969 | Abramowitz | 128/65 |
| 3,552,870 | 1/1971 | Brooks | 401/206 |
| 3,618,629 | 11/1971 | Heyer et al. | 137/218 |
| 3,642,181 | 2/1972 | Thomas et al. | 222/517 |
| 3,669,138 | 6/1972 | Schoepe et al. | 137/218 |
| 3,670,760 | 6/1972 | Butcher et al. | 137/218 |
| 3,748,678 | 7/1973 | Ballou | 15/24 |
| 3,765,455 | 10/1973 | Countryman | 251/342 |
| 3,888,461 | 6/1975 | Bron | 251/351 |
| 3,943,591 | 3/1976 | Lanusse | 15/29 |
| 3,989,391 | 11/1976 | Thorner | 15/29 |
| 4,175,300 | 11/1979 | McGlew et al. | 15/24 |
| 4,211,247 | 7/1980 | Morganroth | 132/88.7 |
| 4,217,059 | 8/1980 | Shelton | 401/219 |
| 4,236,840 | 12/1980 | Kennedy | 401/42 |
| 4,407,213 | 10/1983 | Evans | 114/222 |
| 4,532,666 | 8/1985 | Smyth | 15/29 |

FOREIGN PATENT DOCUMENTS

| | | | |
|---|---|---|---|
| 519342 | 12/1955 | Canada . | |
| 813149 | 9/1951 | Fed. Rep. of Germany . | |
| 927621 | 5/1955 | Fed. Rep. of Germany . | |
| 2153439 | 10/1970 | Fed. Rep. of Germany . | |
| 2203968 | 1/1972 | Fed. Rep. of Germany . | |
| 852547 | 10/1938 | France . | |
| 1239099 | 10/1959 | France . | |
| 566018 | 8/1957 | Italy . | |
| 6500078 | 1/1965 | Netherlands . | |
| 847098 | 9/1960 | United Kingdom | 251/342 |
| 1107560 | 9/1965 | United Kingdom | 251/342 |

*Primary Examiner*—A. Michael Chambers

*Attorney, Agent, or Firm*—Christie, Parker & Hale

[57] ABSTRACT

A valve for fluids with a fluid conduit having a first and a second end. A baffle within the conduit has a first face oriented towards the first conduit end and a second face oriented towards the second conduit end. A baffle seat within the conduit between the baffle and the second end is arranged so that when the second baffle face rests against the seat fluid flow through the conduit is substantially blocked. An operating element, preferably a rod, is moveable relative to but capable of bearing against the baffle to separate the baffle from the baffle seat.

56 Claims, 10 Drawing Sheets

AUTOMATIC FLUID VALVE

CROSS REFERENCE TO RELATED APPLICATIONS

This application is a continuation-in-part of U.S. Pat. application Ser. No. 097,132, filed Sept. 16, 1987 entitled Cleaning Implement with Automatic Water Shut-Off; now abandoned, and a continuation-in-part of U.S. Pat. application Ser. No. 263,958, filed Oct. 26, 1988 entitle Brush with Automatic Water Shut-Off, now U.S. Pat. No. 4,895,468 issued Jan. 23, 1990 which is a continuation of U.S. Pat. application Ser. No. 045,323, filed May 4, 1987 (now abandoned); and a continuation-in-part of U.S. Pat. application Ser. No. 282,987, (now abandoned) filed Dec. 2, 1988 entitled Automatic Fluids Valve, which is a continuation of U.S. Pat. application Ser. No. 165,636, filed Mar. 8, 1988 entitled Automatic Water Valve; now abandoned, and a continuation-in-part of U.S. Design Pat. application Ser. No. 163,066, filed Mar. 2, 1988 entitled Cleaning Implement now abandoned and Ser. No. 163,065, filed Mar. 2, 1988 entitled Water Controlled Cleaning Implement now U.S. Pat. No. 4,361,156. The disclosure of each of the aforementioned applications is incorporated herein by reference.

FIELD OF THE INVENTION

The present invention relates generally to the field of valves, and more particularly, is directed to a novel valve which is adapted to be connected to a conventional garden hose and which is provided with automatic water shut-off capabilities.

DESCRIPTION OF THE PRIOR ART

It is known to employ various types of water valves which are adapted for connection to a source of water under pressure, for example a conventional garden hose. Such water valves usually comprise manual water control means to manually turn on or turn off the flow of water from the hose through the device. Other water control devices have been developed which can permit automatic water flow under the designed conditions, but all suffer from a number of disadvantages.

Water valves suitable for water hose attachment have been developed by prior workers in the art. The valve disclosed in U.S. Pat. No. 2,441,704 to Jackson, for example, includes an elongated valve stem rigidly connected to a valve. The valve stem is designed to be deflected sideways by bending the hose to permit the flow of water.

In U.S. Pat. No. 2,525,614 to Peck, a valve having an elongated valve stem is mounted within a casing which is affixed to a flexible tube. A squeezable grip is provided to allow the operator to bend the flexible tube to thereby longitudinally offset the valve stem to cause water flow.

U.S. Pat. No. 3,888,461 to Bron shows a ball valve actuated by pivoting a spout. A rod rigidly connected to the pivoting spout pushes the ball off its seat to cause water flow.

U.S. Pat. No. 1,181,594 to Hinkle discloses a valve in a floor brush in which a rod connected to a diskshaped shut-off member in a water flow passage is cam actuated when a long handle, connected to the floor brush, is pivoted relative to the floor brush. The valve is cam operated to an open condition allowing water flow into a cavity as the handle is rotated toward the floor towards a position more closely aligned with the horizontal plane of the floor and brush. Water flows out of the bristles of the brush from the cavity by pushing down on a piston type cover over the cavity with the handle.

Despite the variety of prior art elongated valve stem equipped valves that have been developed to date, the need remains to provide an improved automatic water valve having suitable valve means within the valve construction itself to permit automatic control by the user of the flow of water directly at the site of use.

While the prior art types of water carrying brushes have generally proved to be effective in use, one common drawback is the fact that hand held brushes have been operated without any convenient method for shutting off the water supply other than by turning a faucet handle at the hose connection to the building water supply. Because of this, it was usually somewhat inconvenient to first have to turn on a remote water supply to apply water under pressure at the brush, then apply the water supplied brush upon the surface to be cleaned and then go back to the remote faucet to turn off the water supply prior to drying the vehicle or other surface.

Despite the variety of prior art water equipped brushes that have been developed to date, the need remains to provide an improved low cost, shut-off valve, suitable for incorporation in a hand held cleaning implement that permits easy and reliable user control of and over the flow of water directly at the user site during use of the implement.

SUMMARY OF THE INVENTION

An embodiment of the present invention is a valve which is convenient and reliable to operate by the user by moving two conduit sections relative to each other and inexpensive to manufacture. When applied to a hand held cleaning implement the valve allows the user easy control over the flow of water during use by simply pressing the cleaning implement against the surface to be cleaned or by actuation in the users two hands.

One disclosed embodiment of the invention is a valve for fluids with a fluid conduit having a first and a second end. A baffle within the conduit has a first face oriented towards the first conduit end and a second face oriented towards the second conduit end. A baffle seat within the conduit between the baffle and the second end is arranged so that when the second baffle face rests against the seat fluid flow through the conduit is substantially blocked. An operating element, preferably a rod, is moveable relative to but capable of bearing against the baffle to separate the baffle from the baffle seat.

The operating rod is preferably located in the conduit and the fluid conduit has first and second portions. The first portion includes the baffle seat and the second portion, a barrier. The first and second portions are moveable relative to each other from the first position, where fluid pressure at the first conduit end forces the baffle against the seat, to a second position where the barrier acts against the operating end of the operating rod, causing the rod to separate the baffle from the seat and allow fluid flow around the baffle. The first and second conduit portions are preferably pivotable with respect to each other and the rod may be moveable relative to the barrier.

The barrier and the operating rod are preferably located within the conduit and the rod is free to move relative to the conduit and the baffle.

Also, preferably, the valve has a flexible conduit portion between the first and second conduit portions for allowing relative movement between the two portions while fluid passes from the first to the second conduit portions. The axis about which the portions pivot is preferably outside the fluid passageway or offset from the operating rod.

The baffle is biased against the baffle seat by fluid under pressure supplied at the first conduit end for flow through the conduit and out the second conduit end.

Preferably, the first face of the baffle, oriented towards the first conduit, is convex. Preferably, the baffle has cutouts to reduce the size of the baffle at selected areas and hence enhance fluid flow around the baffle as it moves off of the seat.

A valve is also disclosed for fluids with a first fluid conduit having a first opening and a second fluid conduit pivotally connected to the first having a second opening. A flexible tube interconnects the first and second conduits and together with the first and second conduits defines a fluid passageway between the first and the second opening. A baffle within the first conduit varies the amount of fluid flow through the fluid passageway and an operating rod communicates with the baffle and the second conduit. Pivoting the first and second conduits with respect to each other causes the flexible tube to bend and the operating rod to move the baffle thereby varying the amount of fluid flow through the fluid passageway. Preferably, the flexible tube is slidable with respect to one of the conduits when the conduits are pivoted with respect to each other.

DESCRIPTION OF THE PREFERRED EMBODIMENTS OF THE INVENTION

Figure 1:
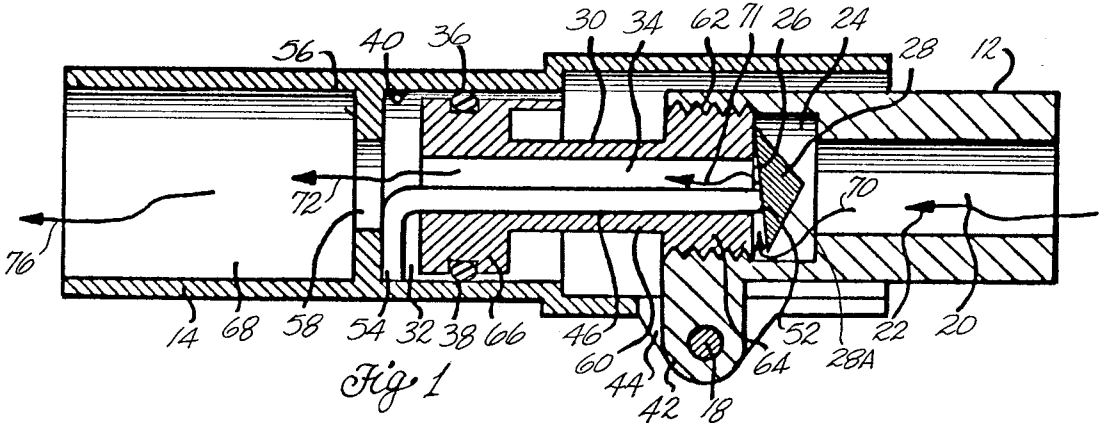
FIG. 1 is a longitudinal cross sectional view of an automatic water valve in accordance with the present invention showing the arrangement of parts to allow water flow.
Figure 2:
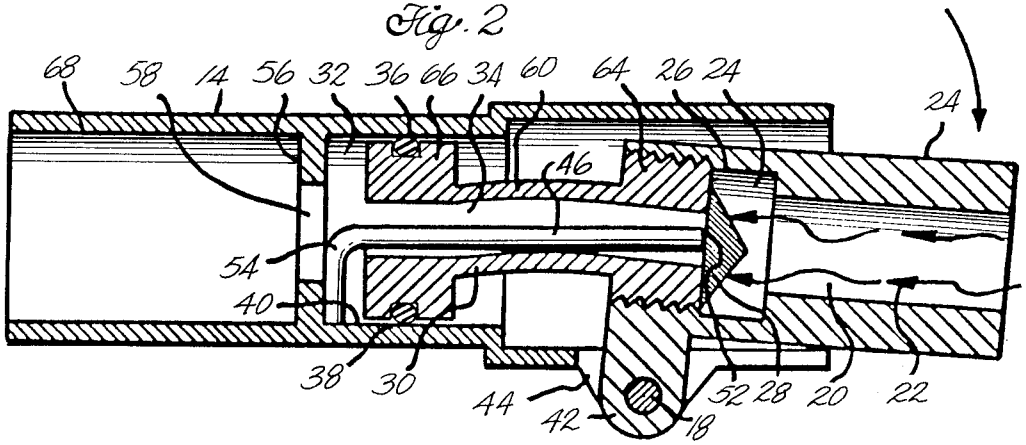
FIG. 2 is a longitudinally cross sectional view of the valve similar to FIG. 1 showing the arrangement of parts to prevent water flow.

FIGS. 1 and 2 show a novel automatic water valve which comprises generally a water inlet section or inlet conduit 12 and a pivotally interconnected water outlet section or outlet conduit 14. The water inlet section 12 terminates rearwardly in a threaded socket or hose connection which is suitable for connection to the threaded end of a usual garden hose (not shown) in conventional manner.

Figures 3, 4:
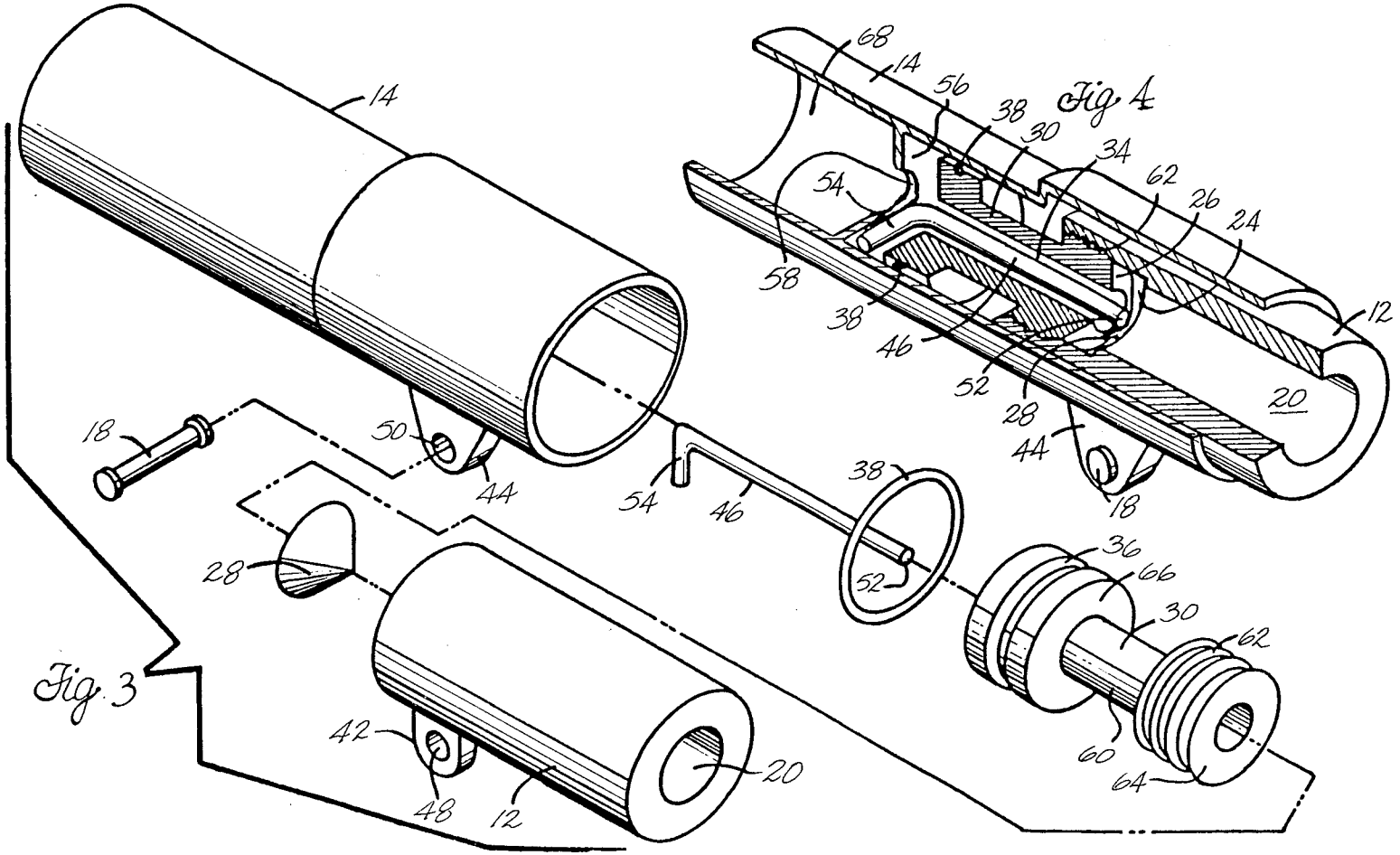
FIG. 3 is an exploded, perspective view of the automatic water valve of FIG. 1.
FIG. 4 is a perspective, one-quarter cut away view of the automatic water valve of FIG. 1.

Still referring to FIGS. 1 and 2 and further considering FIGS. 3 and 4, the water inlet section 12 constitutes a water conduit defining a water passageway 20 to permit water flow therethrough in the direction indicated by the arrow 22. The passageway 20 is in fluid communication with the water inlet end, which may be a threaded hose connection (not shown) and terminates forwardly in a baffle or valve chamber 24, which chamber is intended to normally be flooded with water under all conditions of use. The valve chamber 24 terminates forwardly in a circular or annular shaped planar valve seat 26 of size and configuration to receive thereon a baffle or flutter valve 28 in sealing engagement. The sealing sides of valve seat and flutter valve may take on other shapes so long as they reliably seal when forced together. Preferably, the baffle or flutter valve 28 has a conical face away from seat 26 and is free to move within the valve chamber 24. As shown, the flutter valve is substantially free to move within the confines of the valve chamber between seated and unseated positions to control the flow of water through the automatic water valve. Thus, flutter valve 28 is not connected to or trapped against operating rod 46. Substantially, the only and preferably the only force tending to close the flutter valve against seat 28 is fluid from the inlet.

As illustrated in FIG. 2 when the automatic valve is not in use, water under pressure will impinge upon the loose flutter valve 28 and will force the valve in the direction of water flow through the valve chamber 24 until it presses upon and seals against the valve seat 26. When the flutter valve 28 is pressed against the seat 26, water flow through the automatic water valve will be interrupted and this construction will function as an automatic shut-off, without requiring any attention on the part of the user.

Still referring to FIGS. 1 and 2, the forward end of the water inlet section 12 is integrally formed with a forwardly extending nozzle or tube 30, which nozzle projects interiorly of the water outlet section 14. As shown, the water outlet section 14 comprises a cooperating, hollow conduit defining a passageway 32 to receive water under pressure from the water inlet section 12. The water inlet section of the nozzle or tube 30 includes an interior water conveying passageway 34, which forms an extension of the water passageway 20 and communicates between the valve chamber 24 and the water outlet section bore or passageway 32. The nozzle 30 is formed with a peripheral groove 36 to receive therein a rubber O-ring seal 38 or other suitable elastomeric type of sealing construction. The O-ring seal or gasket 38 bears against the inner periphery 40 of the water outlet section conduit 14 to prevent any back-flow or loss of water at the interconnection between the water inlet section 12 and the water outlet section 14 under all pivoted positions of use.

A first pivot lug 42 projects from the outer periphery of the water inlet section 12 below the valve chamber 24 and cooperates with a second pivot lug 44 which projects from the outer periphery of the water outlet section 14. A pivot pin 18 extends through aligned openings 48, 50 respectively provided in the first and second lugs 42, 44 to allow limited pivotal movement between the water inlet section 12 and the water outlet section or conduit 14. As illustrated in FIG. 2 when the automatic water valve is in its initial or deactuated condition, the water outlet section 14 will normally be angularly positioned relative to the water inlet section 12 about the pivot pin 18 to straighten the nozzle or tube 30 to its longest possible extent. The angularity is produced by the contact between the rearward end 52 of the baffle or valve operating rod or operating element 46 and the flutter valve 28 which in turn causes forward movement of the operating rod or element and consequent pivoting of the outlet section 14.

Water pressure from the water source is applied directly upon conically-shaped surface 28A of the flutter valve 28 and this functions to urge the flutter valve 28 toward and tightly against its seat 26. The flutter valve movement will result in automatic water shut-off inasmuch as the water passageway 34 within the nozzle 30 will be isolated from water introduced at the water inlet end of the water inlet section 12 by the flutter valve 28 as it seals against its seat 26. Additionally, the action of the water pressure upon the flutter valve will force the flutter valve forwardly within the valve chamber 24, thereby causing the flutter valve 28 to urge the operating rod 46 forwardly. The interaction of the operating rod transverse or bent forward end 54 against a stationary circular barrier 56 formed in the water outlet section 14 will cause the water outlet section 14 to pivot relative to the water inlet section 12 about the pin 18. With the parts positioned as shown in FIG. 2, the valve seat 26 will be pivoted as far away from the rear of the abutment or barrier 56 as possible and the additional linear distance thus provided will enable the flutter valve 28 to seal against the valve seat 26 under the impetus of the water pressure.

The valve operating rod 46 is free from the flutter valve and barrier to be movable within the water outlet section water passageway 32. The operating rod 46 may be fabricated of metal or hard plastic and is normally positioned so that its valve contact or rearward end 52 extends rearwardly beyond the seat 26 when the nozzle 30 is pivoted or bent as illustrated in FIG. 1. As a result, the nozzle is shortened. This shortening of the nozzle 30 causes the operating rod 46 to force the flutter valve 28 away from the seat 26, thereby allowing water to freely flow through the automatic water valve 10 as indicated by the arrows 22, 70, 71, 72, 76. The forward end 54 of the valve operating rod 46 is preferably bent at right angles to the axis of the rod and abuts against the stationary circular abutment or barrier 56 which is interiorly positioned in the water outlet section 14 to thereby positively limit the forward travel of the operating rod 46 within the communicating water passageways 20, 32, and 34.

As best seen in FIGS. 1, 2 and 3, the nozzle or tube 30 is provided with a rearward connector 64 having connecting threads 62 to facilitate assembly with the inlet section 12 and to provide easy access to the flutter valve 28. The nozzle 30 terminates forwardly in an enlarged sealing block 66 of dimensions to slide within the interior bore which defines the hollow passageway 32. The sealing block 66 is machined or otherwise treated to form a circumferential or peripheral groove 36 within which is positioned the O-ring gasket 38 for sealing engagement upon the inner peripheral surface 40 of the passageway 32. As shown in FIG. 1, the narrow neck 60 of the nozzle 30 is designed and intended to slightly bend or flex as necessary to allow the water inlet and outlet sections 12, 14 to pivot about the pin 18 between water flow and water shut-off positions.

Accordingly, the barrier 56 will urge the operating rod 46 to its rearwardmost position when the parts are pivoted to bend the nozzle 30 whereby the rearward end 52 of the operating rod will be pushed rearwardly past the plane of the valve seat 26. The operating rod will thereby automatically force the flutter valve 28 from the seat 26, thus causing automatic flow of water through the automatic water valve.

When the flutter valve 28 is upset or forced off of its seat 26, water will flow through the water inlet portion 12 as indicated by the arrow 22, through the valve seat 26 as indicated by the arrows 70 and 71, through the passageway 34 of the nozzle, through the outlet conduit passageway 32, through the concentric opening 58 provided in the barrier 56 as indicated by the arrow 72 and through the discharge passageway 68 of the water outlet section 14 as indicated by the arrow 76. In this actuated condition, the water outlet section or nozzle 30 and the output section 14, will be axially aligned with the water inlet section 12 in the manner illustrated in FIG. 1.

Figure 5:
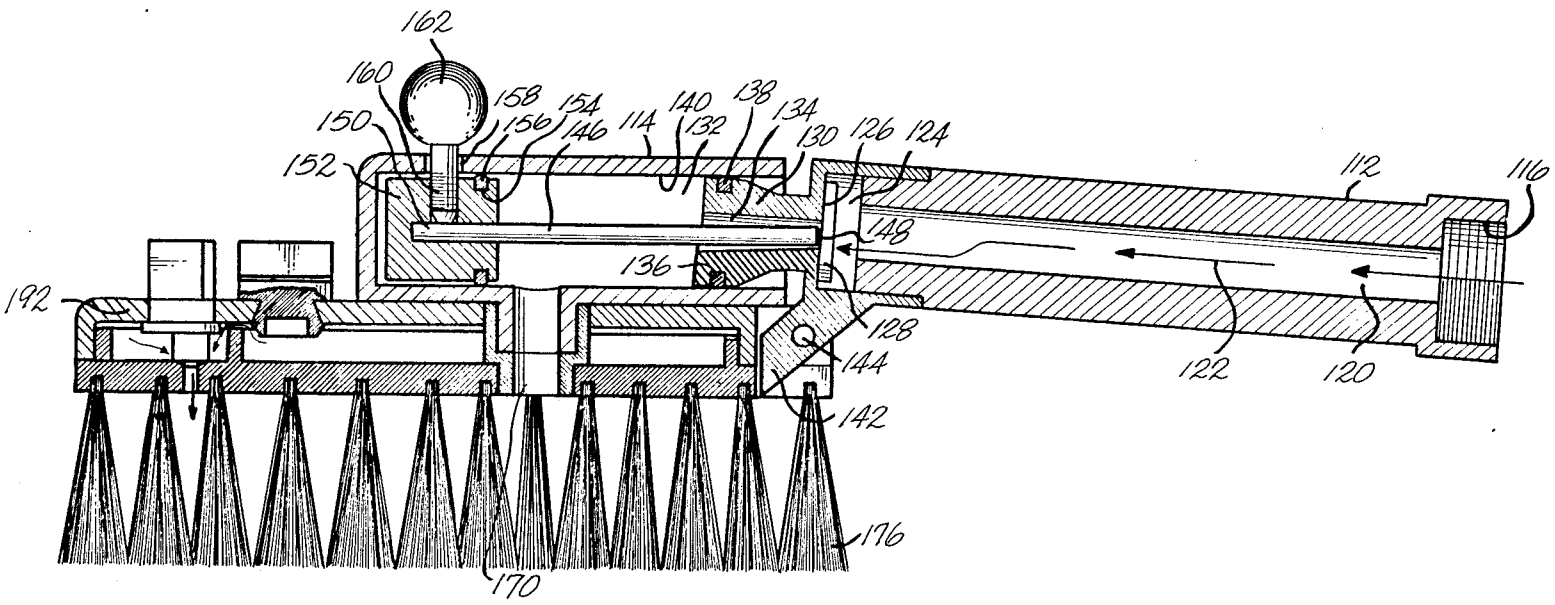
FIG. 5 is a cross sectional view of an alternate valve, in accordance with the present invention, incorporated into a cleaning implement with automatic water shut-off showing the valve in its normally closed position.
Figure 6:
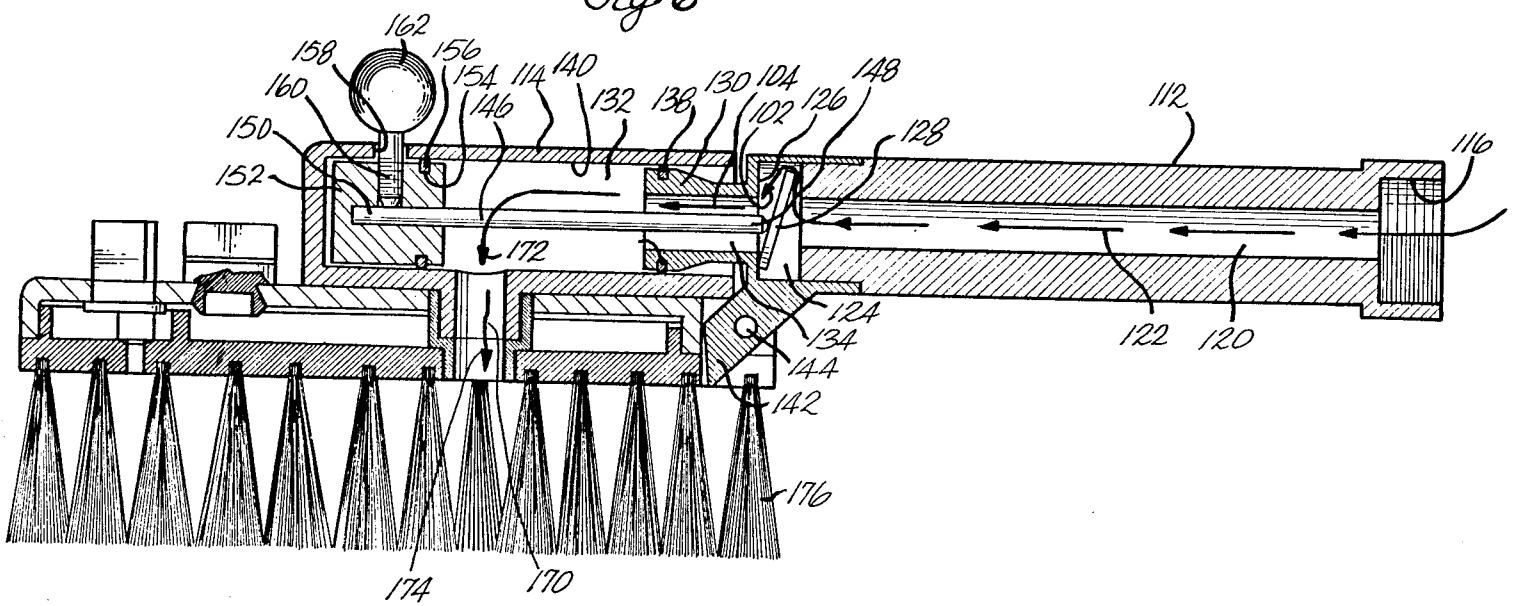
FIG. 6 is a cross sectional view of the cleaning implement of FIG. 5 showing the valve actuated or open.

Referring now to FIGS. 5 and 6, there is shown an alternate embodiment of the present invention. In this embodiment a valve is incorporated into a cleaning implement with automatic water shut-off. The implement comprises generally a handle portion or conduit 112 and a pivotally connected body portion or conduit 114. The handle portion 112 terminates rearwardly in a threaded socket 116 which is suitable for connection to the threaded end of a usual garden hose (not shown) in the conventional manner.

The handle portion 112 is provided with an axial water passageway 120 to permit water flow therethrough in the direction indicated by the arrow 122. The passageway 120 extends from the threaded socket 116 and terminates forwardly in an open baffle or valve chamber 124, which chamber is intended to normally be filled with water under all conditions of use. The baffle or valve chamber terminates forwardly, preferably, in a flat seat 126 of size and configuration to receive thereon a disc shaped baffle or flutter valve 128 in sealing engagement. Preferably, the baffle or flutter valve is not connected within the valve chamber and is free to move therein between seated and unseated positions to control the flow of water through the cleaning implement. As illustrated in FIG. 5, when the brush is not in use, water under pressure will impinge upon the loose flutter valve 128 and will force the valve through the valve chamber 124 until it presses upon and seals against the valve seat 126. When the flutter valve 128 is pressed against the seat 126, water flow through the brush will be interrupted and this construction will function as an automatic shut-off, without requiring any attention on the part of the user.

The forward end 118 of the handle portion 112 is integrally formed with an extending flexible nozzle or tube 130 which projects interiorly of the body portion 114. The handle portion 112 includes a cooperating, hollow passageway 132 to receive water under pressure from the handle portion 112. The nozzle 130 includes an interior water conveying bore or passageway 134, which intercommunicates between the valve chamber 124 and the passageway 132. The nozzle 130 is formed with a peripheral groove 136 to receive therein a rubber O-ring seal 138 or other suitable elastomeric type of sealing construction. The O-ring seal 138 bears against the inner periphery 140 of the conduit 114 to prevent any backflow or loss of water at the interconnection between the handle portion 112 and the body portion 114 under all pivoted positions of use.

A pair of connecting lugs 142 forwardly project form the handle portion 112 below the nozzle 130 and into recesses provided in the body portion 114. A pivot pin 144 extends through the body conduit 114 and the lugs 142 to allow limited pivotal movement between the handle portion 112 and the brush portion 114.

As illustrated in FIG. 5, when the cleaning implement is in its initial, unused or deactuated condition, the handle portion 112 is normally angularly cocked relative to the axis of passageway 132 in body portion 114 about the pivot pin 144. The angularity is produced by the force exerted on an end of valve operating rod 146 contacting the flutter valve 128. With the parts angularly cocked as shown in FIG. 5, the valve seat 126 will be pivoted away from the rear of the operating rod 146 whereby the baffle or flutter valve 128 will be free to seal against the valve seat 126 under the impetus of the water pressure.

The valve operating rod 146 is axially moveable through the hollow passageway 132. The operating rod may be fabricated of metal or hard plastic and is normally positioned so that its valve contact end 148 extends rearwardly beyond the seat 126 when the parts are axially aligned as in FIG. 6. This forces the flutter valve 128 away from the seat 126, thereby allowing water to freely flow through the brush. The forward end 150 of the valve operating rod 146 is preferably encapsulated within a plastic or other suitable material slide block 152 in a non-releasable interconnection, for example, by employing a suitable cement or by a friction fit. The slide block 152 is designed and configured to have limited axial movement within the interior of the brush portion hollow passageway 132. As shown, the slide block is provided with a peripheral groove 154 of known construction and dimensions to receive and secure therein a suitable sealing element, for example, a conventional O-ring gasket 156. The gasket 156 seals the slide block 152 against the inner periphery 140 of the conduit 114 to prevent water leakage thereabout under all conditions and positions of use the slide block 152.

The brush portion 114 is provided with an adjusting slot 158 which is angularly offset from the longitudinal axis of the brush to provide a camming action to adjust the axial position of the valve operating rod 146. An operating lever 160 extends from the slide block 152 and projects through the slot 158. The operating lever terminates exteriorly of the body portion conduit 114 in the rounded or thumb knob 162.

When the knob 162 is pushed in one direction, the operating lever 160 will be urged rearwardly as it travels through the camming adjusting slot 158 to thereby force the slide block 152 and the attached valve operating rod 146 rearwardly relative to the brush portion 114. The rearward movement of the valve operating rod 146 will cause the valve contact end 148 to enter further into the valve chamber 124, past the plane of the flat seat 126 to impinge upon the flutter valve 128 and to force the flutter valve away from the seat 126. Under this condition, water can be made to flow continuously through the brush for application upon a car or other surface (not shown).

When the operating lever 160 is oppositely moved, the thumb knob 162 will urge the operating lever 160 forwardly relative to the brush portion 114. In this position, the slide block 152 will be urged forwardly within the interior of the brush portion to thereby pull the valve operating rod 146 forwardly. When the slide block 152 is forwardly moved, the valve contact end 148 will be caused to approach the plane of the valve seat 126, thereby allowing the flutter valve 128, under pressure from the impinging water (not shown) to more closely approach the seat. This will restrict flow through the valve to thereby control the volume of flow, without entirely shutting off the water flow.

The geometry of the system is so designed that the handle portion 112 can pivot about an axis through the pivot pin 144 relative to the brush portion 114 to thereby pull the valve contact end 148 forwardly of the plane of the valve seat 126. In this position, the flutter valve 128 will be pushed by the water pressure flush against the valve seat 126 to thereby positively close the valve and thereby shut off the flow of water through the brush. Only when the parts are pivoted about the pin 144, for example when the brush portion is applied against the surface to be cleaned, will the valve contact end 148 push sufficiently against the flutter valve 128 to unseat the flutter valve and thereby permit water flow through the device.

Referring to FIG. 6 the body or brush portion 114 is formed with a generally planar, hollow body which is provided at its outlet with a discharge opening or nozzle 170 which is in fluid communication with the hollow passageway 132 of the brush portion or conduit 114. Accordingly, when the flutter valve 128 is upset or forced off of its seat 126, water will flow through the handle portion 112 as indicated by the arrow 122, through the passageway 132 as indicated by the arrow 172 and through the discharge opening 170 as indicated by the arrow 174 to directly impinge upon the surface to be cleaned. A plurality of bristles 176 are secured to the body portion 114 in a well known manner to provide a conventional cleaning assembly in a manner to dislodge dirt and other extraneous material from the surface to be cleaned (not shown) in a conventional manner.

In use, a garden hose (not shown) should be connected to the threaded socket 116 in the usual manner and water should be allowed to impinge upon the flutter valve 128. With the bristles 176 not in contact with any surface to be cleaned, the water under pressure will be sufficient to force the flutter valve 128 against the seat 126 in a manner to contact the valve contact end 148 and handle portion 112 to respectfully pivot about the pivot pin 144 relative to each other until the flutter valve 128 tightly seals upon the seat 126, thereby preventing water flow through the brush. In this condition, the deactuated condition, the handle portion 112 will be angularly cocked relative to the body or brush portion 114 in the manner illustrated in FIG. 5.

By contacting the surface to be cleaned with the bristles 176, the handle portion 112 and body or brush portion 114 will be pivoted about the pivot pin 144 to their aligned positions in the manner illustrated in FIG. 6, thereby causing the valve contact end 148 of the valve operating rod 146 to push against the flutter valve 128. This push will force the flutter valve to leave its seat 126, whereby water will flow through the passageway 120 as indicated by the arrow 122 (FIG. 6), through the valve chamber 127 as indicated by the arrow 102, though the nozzle passageway 134 as indicated by the arrow 104, through the passageway 132 as indicated by the arrow 172 and through the discharge opening or nozzle 170 as indicated by the arrow 174 for direct impingement upon the surface to be cleaned. To stop the flow of water, all that need be done is to remove the bristles 176 from contact with the surface being cleaned, whereby the water pressure will again force the flutter valve 128 against its seat 126.

Continuous flow of water through the brush can be achieved by urging the operating lever 160 to the right or rearwardly along the adjusting slot or groove 158 to a position whereby the valve contact end 148 will always upset the flutter valve to thereby assure continuous water flow. To adjust the volume of flow, the operating lever 160 can be moved.

Figure 7:
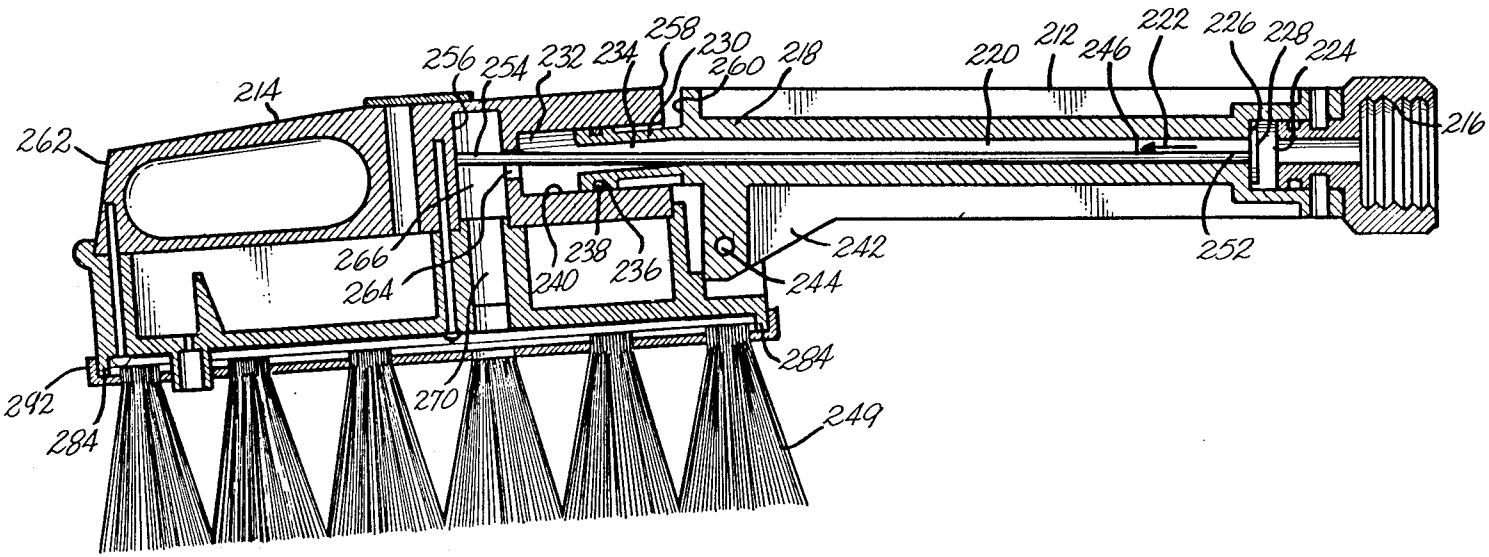
FIG. 7 is a cross sectional view of another cleaning implement disclosing an alternate valve, in accordance with the present invention, with automatic water shut-off showing the valve deactuated or closed.
Figure 8:
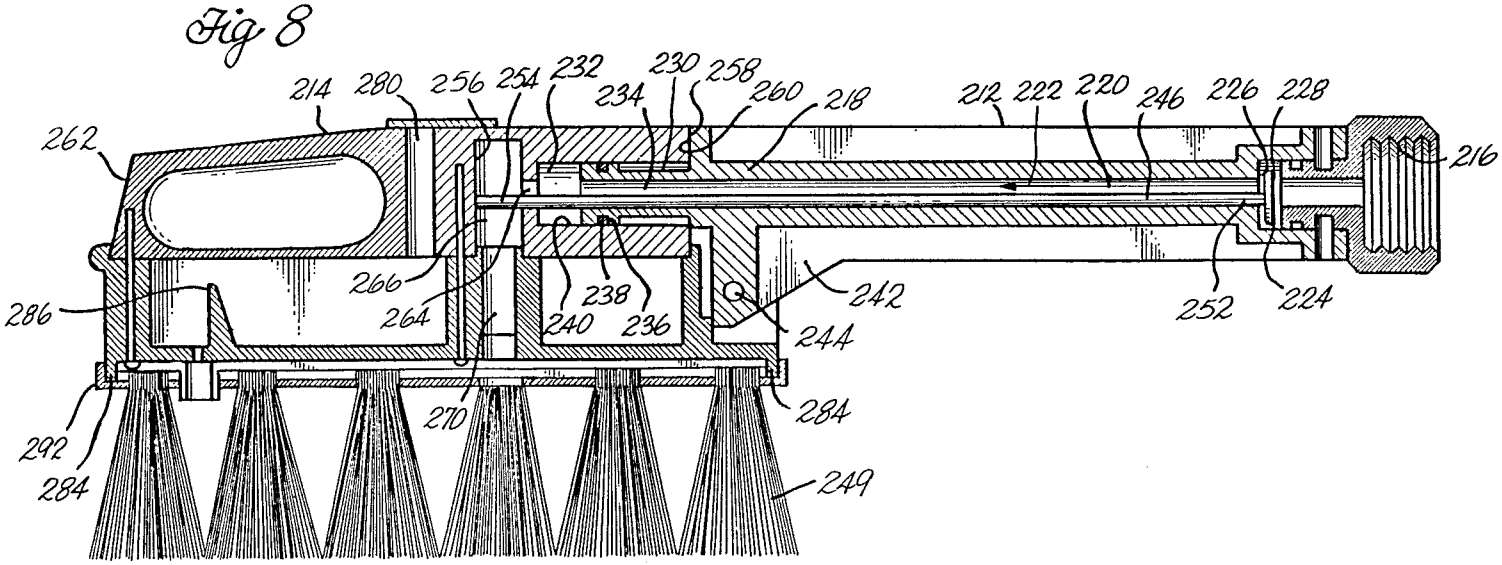
FIG. 8 is a cross sectional view of the cleaning implement of FIG. 7 showing the valve actuated or open.
Figure 8A:
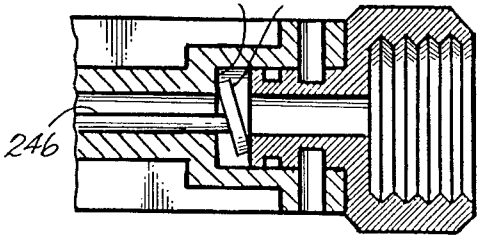
FIG. 8A is a cross sectional view of the baffle chamber in the cleaning implement of FIGS. 7 and 8 showing the baffle tilted open to allow water flow around the baffle.

FIGS. 7, 8 and 8A show a further cleaning implement. This cleaning implement incorporates a further valve according to the present invention which comprises generally a handle portion or conduit 212 and a pivotally interconnected body portion or conduit 214. The handle portion 212 terminates rearwardly in a threaded socket 216 which is suitable for connection to the threaded end of a usual garden hose (not shown) in conventional manner.

As best seen in FIGS. 7 and 8, the handle portion 212 is provided with an axial water passageway 220 to permit water flow therethrough in the direction indicated by the arrow 222. The passageway 220 is in fluid communication with the threaded socket 216 and terminates rearwardly in a baffle or valve chamber 224, which chamber is intended to normally be filled with water under all conditions of use. The valve chamber 224 terminates forwardly in a circular, planar seat 226 of size and configuration to receive thereon a baffle or flutter valve 228 in sealing engagement. Preferably, the flutter valve 228 is separate from and is not connected within the valve chamber 224 to either operating rod 246 or valve chamber 224 and is free to move therein between seated and unseated positions to control the flow of water through the cleaning implement.

As with the other illustrated embodiments and as illustrated in FIG. 7, when the cleaning implement is not in use, water under pressure will impinge upon the loose flutter valve 228 and will force the valve through the valve chamber 224 until it presses upon and seals against the valve seat 226. When the flutter valve 228 is pressed against the seat 226, water flow through the brush will be interrupted and this construction will function as an automatic shut-off, without requiring any attention on the part of the user.

The forward end 218 of the handle portion 212 is integrally formed with an extending nozzle or tube 230 which projects interiorly of the body portions 214. The body portion 214 includes a cooperating, hollow passageway 232 to receive water under pressure from the handle portion 212. The nozzle 230 includes an interior water conveying bore or passageway 234, which forms an extension of the handle portion passageway 220 and communicates between the valve chamber 224 and the passageway 232. The nozzle 230 is formed with a peripheral groove 236 to receive therein a rubber O-ring seal 238 or other suitable elastomeric type of sealing construction. The O-ring seal 238 bears against the inner periphery 240 of the body portion or conduit 214 to prevent any backflow or loss of water at the interconnection between the handle portion 212 and the body portion 214 under all pivoted positions of use.

A pair of connecting lugs 242 (only one shown) forwardly project from the handle portion 212 below the passageway 220 and into recesses provided in the body portion 214. A pivot pin 244 extends along an axis through the body portion 214 and the lugs 242 to allow limited pivotal movement between the handle portion 212 and the body portion 214. As illustrated in FIG. 7 when the cleaning implement is in its initial, unused or deactuated condition, the handle portion 212 is normally angularly cocked relative to the body portion 214 about the pivot pin 244. The angularity is produced by the force on the rearward end 252 of a valve operating rod 246 contacting the baffle or flutter valve 228. Water pressure upon the flutter valve 228 urges the flutter valve 228 tightly against its seat 226. This results in automatic water shut-off inasmuch as the water passageway 220 will be isolated from water introduced at the threaded socket 216 by the flutter valve 228. Additionally, the action of the water pressure upon the flutter valve causes the flutter valve 228 to urge the operating rod 246 forwardly. The interaction of the operating rod forward end 254 against a stationary barrier 256 causes the body portion 214 to pivot about the pin 224. With the parts angularly cocked as shown in FIG. 7, the valve seat 226 is pivoted away from the rear of the operating rod 246 whereby the flutter valve 228 is free to seal against the valve seat 226 under the impetus of the water pressure.

The valve operating rod 246 is free from the rod and valve chamber so that it is axially and transversely moveable through the passageway 232. The operating rod may be fabricated of metal or hard plastic and is normally positioned so that its valve contact or rearward end 252 extends rearwardly beyond the seat 226 when parts are axially aligned as in FIG. 5.

Figure 10:
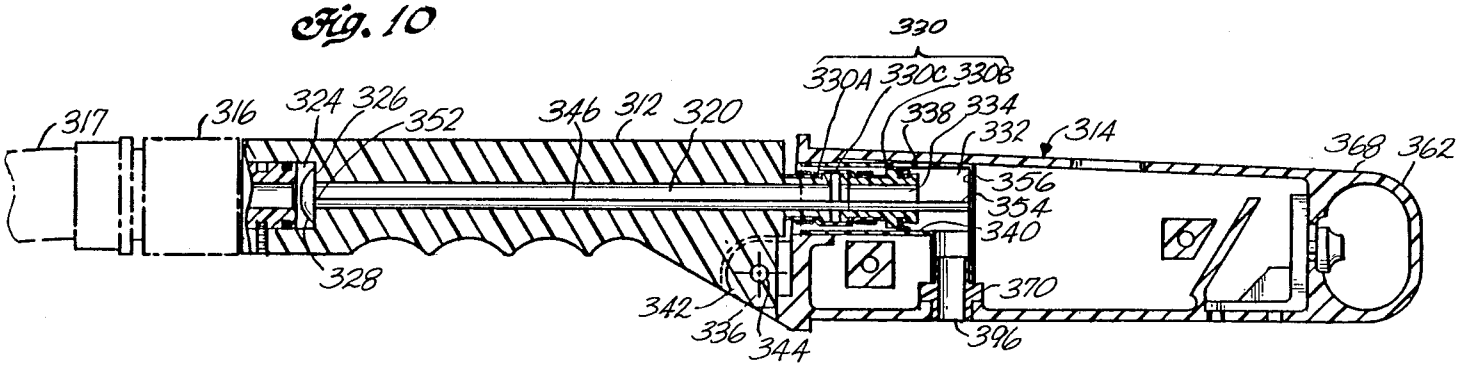
FIG. 10 is a cross sectional view of the cleaning implement of FIG. 9, taken along the Lines 10—10, showing the fluid conduits aligned so that the valve is deactuated or closed to block fluid flow.

When the body portion 214 is employed for cleaning purposes by applying bristles 249 fastened to the body portion 214 against a surface to be cleaned, the application forces on the handle portion 212 will easily be sufficient to overcome the impetus of the water pressure upon the flutter valve 228. This causes the body portion 214 to pivot in a clockwise direction relative to the handle portion 212 about the pivot pin 244 until the rear wall 258 of the body portion 214 abuts and stops against a forward flange 260 of the handle portion 212. With the parts in this position, as illustrated in FIG. 8, the passageways 220, 232, 234 are in axial alignment and the barrier 256 will be pivoted to its closest possible position to the valve seat 226. Accordingly, the barrier 256 urges the operating rod 246 to its rearwardmost position whereby the rearward end 252 of the operating rod is pushed rearwardly past the plane of the valve seat 226. The operating rod thereby automatically forces the flutter valve 228 from the seat, thus causing automatic flow of water through the cleaning implement. Under this condition, the actuated condition, water flows continuously through the cleaning implement for application upon a car or other surface (not shown). FIG. 8A shows an enlarged view of the flutter valve when it is urged off its seat in the actuated condition. As can be seen from FIG. 8A, the operating rod 246 contacts only a small portion of the surface of the flutter valve. Accordingly, the water under pressure, impinging against the flutter valve, tilts the freely movable flutter valve 228 with the portion farthest from the operating rod in contact with the valve seat 226. The valve is more easily moved from its seat against the force of the impinging water when the flutter valve is allowed to tilt as shown in FIG. 8A. This action is also depicted in the embodiment of FIGS. 1, 6 and 10.

The removal of the bristles 249 from the surface being cleaned will allow the water pressure upon the flutter valve 228 to forwardly urge the operating rod 246, thereby causing counter-clockwise rotation of the body portion 214 relative to the handle portion 212 about the pivot pin 244. See FIG. 7. In this condition, the rearward end 252 of the operating rod is urged forwardly of the plane of the valve seat 226, thereby allowing the flutter valve 228 to contact the valve seat 226 to automatically stop water flow.

An interchangeable brush or sponge (not shown) is used with the body portion 214, depending upon the nature of the surface to be cleaned. In the illustrated embodiment, the body portion 214 is provided with a depending skirt 284 to removably receive thereon a tight-fitting, peripheral flange 292 which can be cooperatively formed in a brush or a sponge. In this manner, either the brush or sponge can be easily removably affixed to the body portion 214. Alternatively, other separable fasteners, for example, "VELCRO" type fasteners can be employed to removably secure a brush or sponge to the body portion 214.

The body portion 214 is formed with a generally hollow body 268 having a convenient handle 262 formed therein. The body 268 is provided with a discharge opening or nozzle 270 which is in fluid communication with the hollow passageway 232 of the brush portion 214 through an axially aligned opening and a directional chamber 266. Accordingly, when the flutter valve 228 is upset or forced off of its seat 226, water will flow through the handle portion 212 as indicated by the arrow 222, through the conduit 232, through the opening 264 and directional chamber 266 and then through the discharge opening or nozzle 270 to directly impinge upon the surface to be cleaned. The water (not indicated) under pressure will change direction within the directional chamber 266 without significant loss of pressure to thereby exit the nozzle 270 as a stream substantially perpendicular to the axis through the pivot.

In use, the cleaning implement of FIGS. 7 and 8 functions in much the same way as that of FIGS. 5 and 6. Continuous flow of water through the cleaning implement is achieved by grasping the handle portion 212 with one hand and the handle 262 of the body portion 214 with the other hand, lifting and holding the implement in the air, and then manually pulling the parts to the axially aligned position of FIG. 8. In this position, as hereinbefore set forth, the flutter valve 228 will be forced from its seat 226 to thereby assure continuous water flow for rinsing of a surface that has been washed with soap or the like.

FIGS. 9 through 13A show an alternate cleaning implement. This cleaning implement incorporates a normally closed valve, according to the present invention. The implement has a handle portion or conduit 312 and a pivotally interconnected body portion or conduit 314. The handle portion 312 terminates at its rear in a fluid or water inlet, a threaded socket connector 316 which is designed for connecting to the threaded end of a typical garden hose 317 in the conventional manner. Along its length, the handle portion includes a handle 313 with finger grips **313*a*** so that the implement may be easily held by the user.

Figure 9:
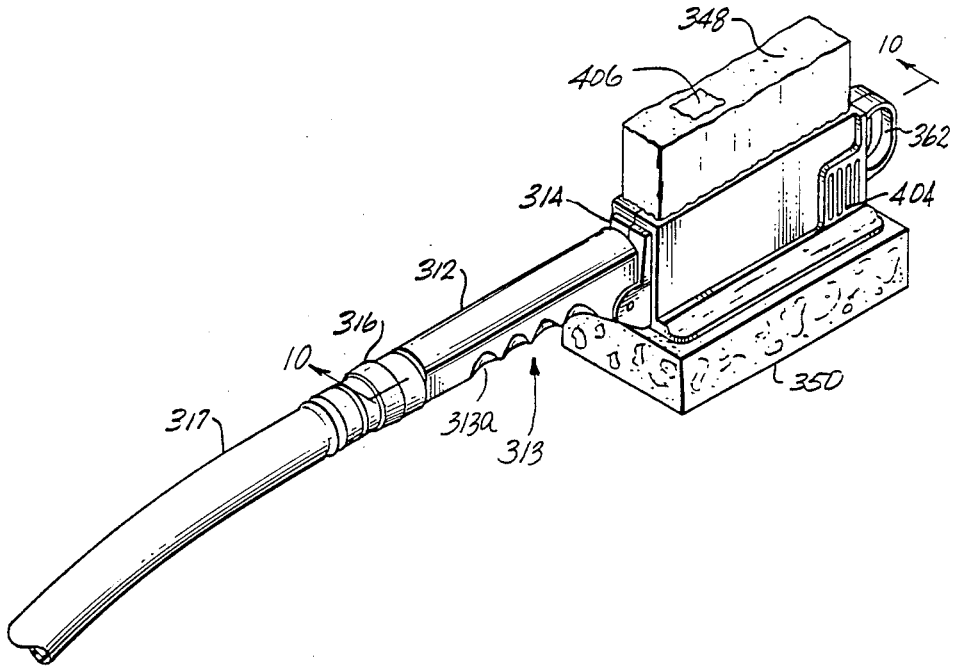
FIG. 9 is a perspective view of another cleaning implement containing another valve and embodying the present invention.
Figure 13:
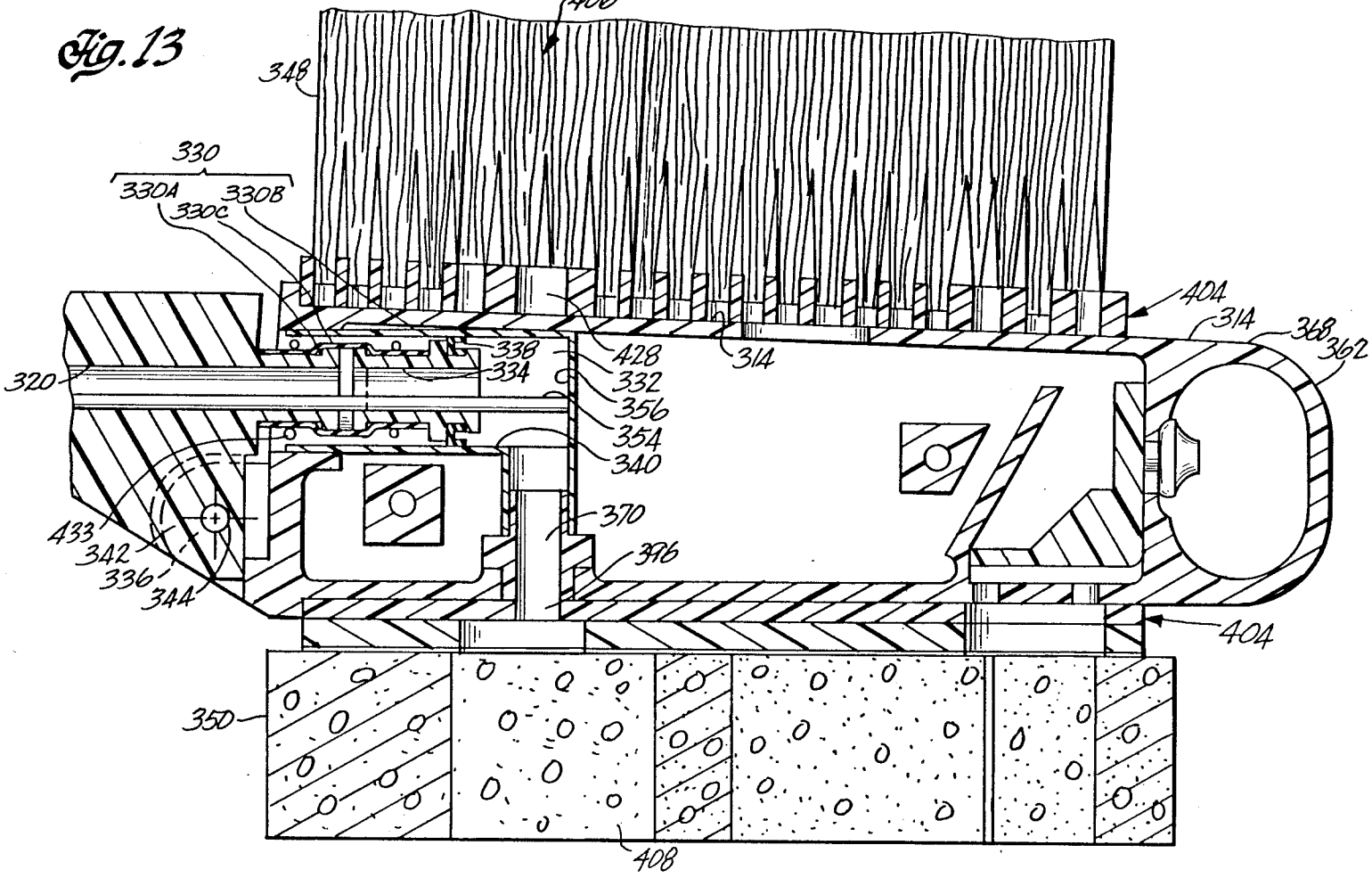
FIG. 13 is an enlarged view of a portion of the cleaning implement of FIG. 11 showing the cleaning head installed with a sponge cleaning element on the bottom side for scrubbing.
Figure 13A:
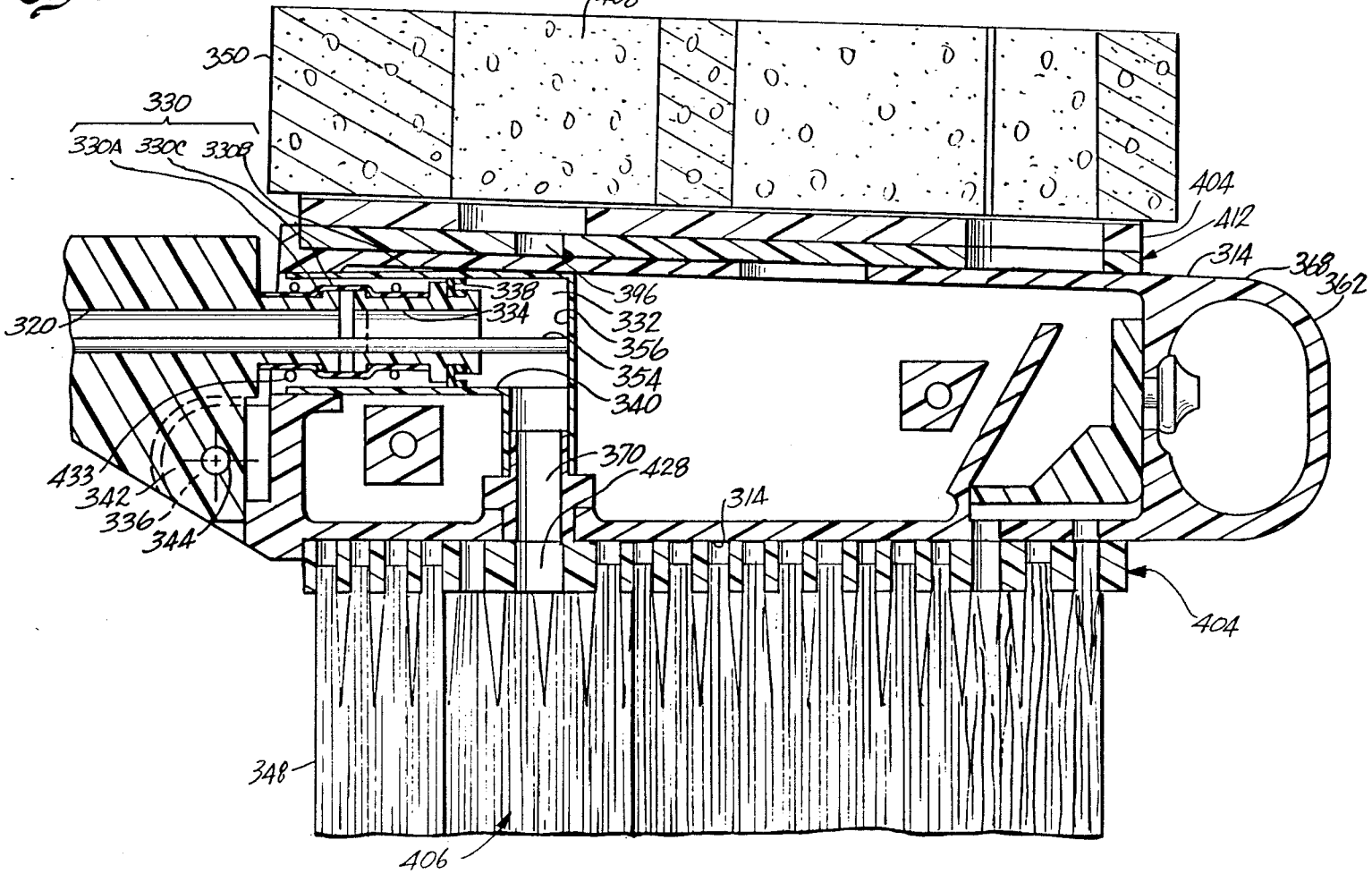
FIG. 13A is a view similar to FIG. 11 with the head reversed so that a brush cleaning implement is on the bottom side for scrubbing.

The present embodiment provides a reversible and removable head 404 which bears both a brush 348 and a sponge 350. The brush and sponge are mounted on opposite facing sides of the exterior of the head. The head interior is hollow and rectangular in cross section and is configured to slidably mount on the similarly shaped exterior of body portion 314 and to be retained there by a friction fit. The head 404 is quickly released by sliding in the reverse direction. The head can be mounted so that the sponge is on the bottom side where water and soap are dispensed as shown in FIGS. 9 and 13. The head can then be removed, inverted and remounted on the body portion 314 so that the brush is at the bottom side where water and soap are dispensed as seen in FIG. 13A.

When the head 404 is installed with the sponge at the bottom, as shown in FIG. 13, water passes through the sponge 350 to directly impinge on the surface to be cleaned. Similarly, when the brush is on the bottom, as seen in FIG. 13A, port 428 and hole or opening 406 through the brush bristles are aligned with nozzle 370 and allow water to pass from nozzle 370 through fluid opening 396 and openings 396, 406 and 428 and to directly impinge on the surface to be cleaned. The opening 406 in the bristles of the brush and the opening 408 through the sponge are sufficiently large considering the focus of the spray and the thickness of the bristles and sponge that a substantial portion or all of the fluid, sprays directly through the openings to directly impinge on the surface to be rinsed, without striking the adjacent bristles and sponge. Very little or no soap is carried by the fluid from the bristles or sponge to the surface during rinsing.

Figure 11:
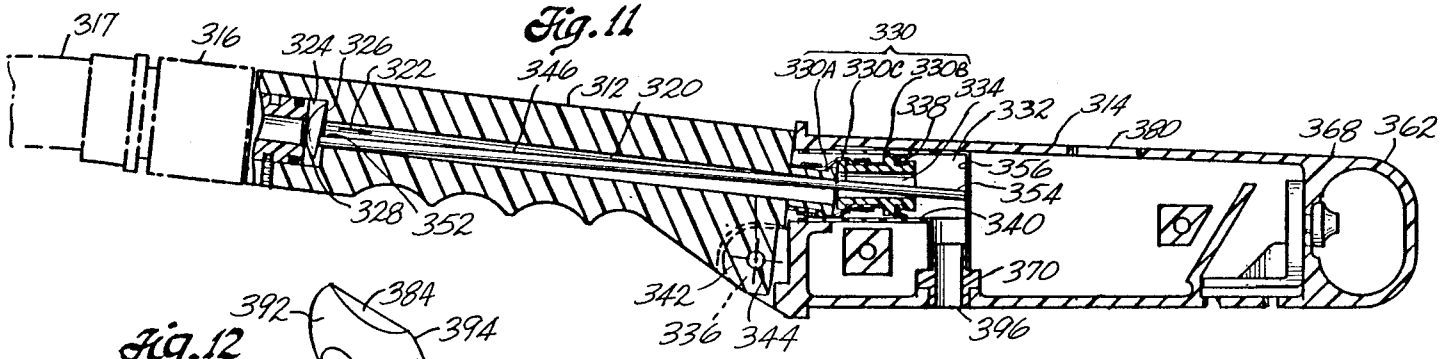
FIG. 11 is a cross sectional view of the cleaning implement of FIG. 9, taken along the Lines 10—10, showing the fluid conduit out of alignment so that the valve is actuated open to allow fluid flow.

The handle portion 312 is provided with an elongated axial water passageway 320 to permit pressurized water flow therethrough in the direction indicated by the arrow 322 (FIG. 11). The passageway 320 is in fluid communication with the inlet or threaded socket connector 316 and terminates at its rear in a baffle or valve chamber 324. The valve chamber is filled with water under all normal conditions of use. The forward end of the valve chamber 324 terminates in an annular valve seat 326. The valve seat 326 receives a baffle or flutter valve 328 which has a planar side that seals against the planar valve seat 326 as shown in FIG. 11. Preferably, the flutter valve 328 is not connected to the valve chamber 324 or the rod and is free to move within the chamber between seated and unseated positions to control the flow of water through the cleaning implement.

As illustrated in FIG. 11, when the cleaning implement is not in use, water under pressure will impinge upon the freely moving flutter valve 328, forcing the valve to press upon and seal against the valve seat 326. When the flutter valve 328 is pressed against the seat 326, it is deactuated and water cannot flow through the conduits and passageways to the nozzle In this manner, the cleaning implement is driven to, an automatic shut-off condition by the fluid pressure and requires no attention from the user.

The baffle or flutter valve 328 has a first face 392 oriented towards the water supply at the inlet end of the handle portion 312 and a second, preferably, planar face 394 oriented towards the valve seat 326. While a flat or disc shaped valve may be used, see e.g. FIGS. 5–8, it is preferred that the first face 392 be convex. The valve of FIGS. 11–14A has a spherical surface with a flat end 398. The convex face reduces the force required to break the seal of the valve against the seat. The size and shape of the flat end 398 of the valve can be selected to control the amount of force by the water tending to close the valve. The larger the flat end the greater the force required to open the valve. The second face 394 of the valve is preferably planar. The plane of the surfaces of 394 and 398 are preferably perpendicular to the axis of elongation of the water passageway through the handle portion. The shape and dimensions of the valve relative to that of the chamber are selected so as to allow the valve to move about without allowing it to become oriented in the wrong direction.

It is also preferred that the shape of the valve not precisely match that of the water passageway through the valve seat or, in other words, that the annular seat be regular in shape and the valve irregular. The valve seat is preferably annular with an annular passageway through its center. The valve, however, has a circular second face with symmetrical oppositely facing cutouts 384 around its perimeter. The cutouts reduce the distance from the valve perimeter to the passageway through the seat to enhance flow through the chamber when the valve is open. More specifically, the cutouts allow water flow around the valve as the valve is tilted by the rod, thereby reducing the force required to tilt the valve from the valve seat. While the valve configuration of FIGS. 11–14 is presently preferred, a similar effect can be achieved using other shapes and configurations in which the distance is varied from the perimeter of the valve face 394 to its center.

The forward end 318 of the handle portion 312 is coupled to flexible nozzle 330 which extends into the body portion 314. As shown, the body portion 314 includes a cooperating cylindrical shaped chamber 332 to receive water under pressure from the handle portion 312. The nozzle 330 is formed by rigid conduit segments 330A, 330B which are spaced apart and coupled by a flexible tubing sleeve 330C. Flexible thin walled tubing is preferred for sleeve 330C. The sleeve is secured by wires 433 wrapped around the tubing and the tube segments. Tube segment 330A is an integral part of the handle portion 312. Tube segment 330B is sealed against the wall of chamber 332 by an annular shaped cup seal 338. The cup seal prevents any backflow or loss of water at the interconnection between the handle portion 312 and the body portion 314, as the handle and body portions pivot. The nozzle 330 includes an interior water conveying passageway 334, which forms an extension of the water passageway 320 and communicates between the valve chamber 324 and the body chamber 332. This forms a continuous water conduit from the water inlet or threaded socket connector 316 along the passageways 320 and 334, chamber 332 and nozzle 370. Water is, therefore, sprayed out slot shaped water discharge opening 396 of nozzle 370. FIGS. 1–8 show nozzles that flex to allow maintaining of the sliding sealed connection between the handle and body portions. Similarly, the flexible tubing sleeve 330C flexes and the cup seal 338 bears continuously against the inner periphery 340 of the wall of chamber 332 to maintain a similar sliding sealed connection as the handle and body portion pivot relative to each other.

A lug 342 projects from the handle portion 312 below the water passageway 320 into a clevis defined by a pair of ears 336 (only one shown by hiding lines) formed in the body portion 314. A pivot pin 344 extends through the ears 336 and the lug 342 to allow limited pivotal movement, on the order of 5° between the handle portion 312 and the body portion 314.

As illustrated in FIG. 11, when the cleaning implement is in its initial, deactuated condition, the rearward end 352 of valve operating rod 346 contacts the flutter valve 328 under pressure. Water pressure upon the flutter valve 328 will urge the flutter valve 328 tightly against its seat 326. This automatically shuts off the water because the water passageway 320 is isolated by the flutter valve 328 from water introduced at the water inlet. In addition, the water pressure upon the flutter valve will cause the flutter valve 328 to push the operating rod 346 forwards. The operating rod's forward end 354, in turn, pushes against stationary barrier 356 causing the body portion 314 to pivot clockwise about the pin 344 to the position indicated in FIG. 11.

The handle and body portions pivot about an axis through pivot pin 344, which is preferably located on the outside of the handle and body portions offset and spaced apart from the fluid passageway. The operating rod 346 is preferably located within the fluid passageway for optimum performance. The distance from the rod to the pivot pin affects how much of an angle the handle and body portions must be pivoted with respect to each other in order to open the valve.

Figure 12:
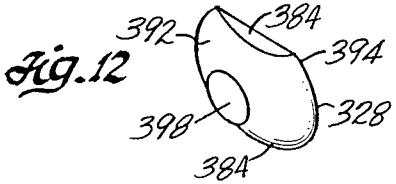
FIG. 12 is an enlarged perspective view of the baffle in the implement of FIGS. 9–13A.

The valve operating rod 346, is normally fabricated of metal or hard plastic, and as illustrated in FIGS. 11 and 12, is free to move axially and transversely within the water passageway 320 and 334 and the passageway formed by chamber 332. Since the operating rod is free to move transversely within the water passageway, and since the rod has a much smaller cross section than the passageway, the rod will normally fall or be forced to one side of the passageway in which it is located. The same is true of the embodiments of FIGS. 1–8. The length of the operating rod 346 is selected so that its valve contacting rearward end 352 extends beyond the valve seat 326 when the handle and body portions are pivoted towards each other as in FIGS. 11 and 13 and the rod is forced by the barrier 356 to move axially through the passageway. Since the operating rod normally lies to one side of the passageway, it will then force one edge of the valve off its seat, tilting the valve. This also occurs in the embodiment of FIGS. 1–8. The water will then flow freely around the portion of the valve which is separated from the seat.

Referring to FIGS. 11 and 13, when the flutter valve 328 is upset or forced off of its seat 326, water flows through the handle portion 312, through chamber 332, and through the discharge nozzle 370 and opening 396 to the surface to be cleaned. The water changes direction within chamber 332 with no significant loss of pressure and exits the nozzle 370, preferably as a narrow wide stream of water due to the narrow opening 396. The nozzle can be made in a variety of shapes, depending on the type of water stream desired using techniques well known in the art. However, the nozzle is preferably selected to provide a stream of higher velocity than that of the fluid at connector 316.

In use, the user holds the handle portion 312 in one hand and applies pressure through an attached cleaning element, such as the sponge or brush, to the surface to be cleaned. Ever so slight pressure applied between the body portion and the handle portion rotates the two portions from the deactuated condition or position in FIG. 10 to the actuated longitudinally aligned condition of FIG. 11. The actuated condition causes the valve, which is operatively coupled to the handle and body portions, to change from a condition blocking fluid flow to a condition allowing fluid flow through the conduits in the handle and body portion to the nozzle 370 from which fluid is sprayed onto the surface to be cleaned. Release of the pressure between, the handle and the brush allows the fluid pressure against the valve to pivot the handle and body portions back to the non-aligned or deactuated condition of FIG. 11 causing the valve to block further fluid flow through nozzle 370.

What has been disclosed is a hand held scrubbing and rinsing implement. The implement is hand holdable, preferably made of all molded plastic parts (except as discussed above, possibly the rod), and preferably weighs in the range of 1¾ pounds to 2 pounds, and more preferably less than 1½ pounds with an overall length of less than 12 to 28 inches and preferably less than 18 inches, allowing the user to easily hold and actuate the implement. Grasping the handle portion and handle on the body portion in this manner, the person rotates the two portions relative to each other, preferably toward the person, with the two hands, causing movement from the deactuated condition to the actuated condition and, as a result, causing the valve to unblock the flow of fluid. The fluid then flows through the passageways of the conduits from the inlet and out of the nozzle 370 away from the person, allowing the fluid to spray passed the cleaning element (i.e., brush or sponge) to directly impinge on the surface. The clean spray of fluid rinses the surface without applying soap. When through rinsing, the person releases the pressure between the handle portion and handle on the body portion, allowing the two portions to rotate back to the deactuated condition and, thereby, cause the valve to block further fluid flow.

The clean water rinse is particularly useful because the brush and sponge will normally be saturated with soap. If the water streaming from the nozzle were to be forced through the brush or sponge to the surface being rinsed, some soap would be carried to the surface being rinsed. The user can scrub or apply soap easily with the cleaning element and then move the cleaning element away from actuation of the user's two hands to spray clean rinse water at the surface being rinsed. The implement is made still more useful because of the automatic operation of the valve.

Although the invention has been described with a certain degree of particularity, it is understood that the present disclosure has been made only by way of example and that numerous changes in the details of construction and the combination and arrangement of parts may be resorted to without departing from the spirit and scope of the invention as defined in the claims. The present disclosure has emphasized a water valve for use with a cleaning implement. However, the valve disclosed herein is suitable for a variety of applications using a variety of fluids. Accordingly, the fluid source need not be a garden hose.

What is claimed is:

1. A fluid valve comprising:

a fluid conduit having a first end and a second end;

a baffle within the conduit between the first and second ends having a first face oriented towards the first conduit end and a second face oriented towards the second conduit end;

a baffle seat within the conduit between the baffle and the second conduit end arranged so that when the second baffle face rests against the seat, fluid flow from the first conduit end to the second conduit end through the conduit is substantially blocked; and an operating element between the baffle and the second conduit end having a baffle end within the conduit and an operating end, the baffle end of the operating element being movable relative to the baffle and operative for separating the baffle from the baffle seat.

2. The valve of claim 1 wherein the operating element comprises a rod.

3. The valve of claim 2 wherein the operating rod is located in the conduit.

4. The valve of claim 3 wherein the fluid conduit comprises:

a first conduit portion comprising the baffle seat; and a second conduit portion comprising the second conduit end and a barrier, the first and second conduit portions being movable relative to each other from a first position, where fluid pressure at the first conduit end forces the baffle against the seat, to a second position where the barrier acts against the operating end of the rod, causing the rod to separate the baffle from the seat and allow fluid flow around the baffle.

5. The valve of claim 4 wherein the first and second conduit portions are pivotable about a mutual pivot point for such relative movement.

6. The valve of claim 5 wherein the first and second conduit portions each comprise a passageway extending along an axis and the axes of the passageways are substantially aligned when the conduit is in one of said positions.

7. The valve of claim 4 wherein the rod is transversely movable in the conduit independent of the barrier and the baffle.

8. The valve of claim 7 wherein fluid under pressure supplied at the first conduit end biases the baffle against the baffle seat.

9. The valve of claim 4 wherein the rod is elongated along an axis and the barrier and conduit guide the rod for movement substantially linearly along such axis during the movement of the first and second conduit portions from the first to the second positions.

10. The valve of claim 4 wherein the barrier is located within the second conduit.

11. The valve of claim 4 wherein the conduit comprises a flexible conduit portion in which the rod extends between the first and second conduit portions for allowing the relative movement while passing fluid from the first conduit portion to the second conduit portion.

12. The valve of claim 4 wherein the first and the second conduit portions each comprise a passageway therethrough and an axis about which pivoting takes place that is displaced from the passageway.

13. The valve of claim 3 wherein the second baffle face and the baffle seat each have a center proximate each other and the rod is capable of movement within the conduit so as to contact the second baffle face at a point offset from the center of the second baffle face so as to tilt the baffle away from the baffle seat.

14. The valve of claim 13 wherein the first and second conduit portions pivot about an axis located outside the conduit.

15. The valve of claim 3 wherein the second baffle face and the baffle seat each have a center proximate each other and the operating rod is capable of limited movement with respect to the second baffle face so as to contact the second baffle face at a point offset from the second baffle face center.

16. The valve of claim 15 wherein the operating element comprises a rod and comprising a barrier for moving the rod and wherein the barrier and the operating rod are located within the conduit and the conduit comprises a flexible portion for flexing as the barrier moves the baffle.

17. The valve of claim 16 wherein the first and second conduit portions pivot about an axis spaced away from the rod.

18. The valve of claim 11 wherein the barrier comprises a wall within the conduit and the operating end of the rod comprises a transverse extending portion for contacting the wall.

19. The valve of claim 16 wherein the fluid conduit is elongated along an axis substantially perpendicular to the second baffle face, wherein the barrier is located within the conduit, wherein the operating rod extends within the conduit substantially parallel to the axis of elongation and wherein the rod comprises a transverse portion proximate the barrier for engaging the barrier.

20. The valve of claim 1 comprising a baffle chamber in the conduit, the baffle being substantially free of the operating element in the chamber.

21. The valve of claim 20 wherein the baffle is substantially free to move in the chamber in the absence of fluid pressure.

22. The valve of claim 20 wherein the operating element is movable relative to the baffle.

23. The valve of claim 20 wherein the operating element is movable transverse to the second face of the baffle.

24. The valve of claim 20 wherein the baffle is substantially free of connections in the chamber.

25. The valve of claim 1 wherein the first baffle face is convex.

26. The valve of claim 1 wherein the baffle seat is annular and the baffle comprises a substantially circular section having an irregular outer perimeter.

27. The valve of claim 1 wherein the second baffle face has an irregular outer perimeter.

28. A fluid valve comprising:

a first fluid conduit having a first opening;

a second fluid conduit having a second opening, the first and second conduits being pivotably connected together at a mutual pivot point;

a flexible tube interconnecting the first and second conduits, the flexible tube together with the first and second conduits, defining a fluid passageway between the first opening and the second opening;

a baffle within the first conduit for varying the amount of fluid flow through the fluid passageway;

an operating element, extending through the flexible element and in communication with the baffle and the second conduit, pivoting of the first and second conduits with respect to each other, causing the flexible tube to bend and the operating rod to move the baffle thereby varying the amount of fluid flow through the fluid passageway.

29. The valve of claim 28 wherein the flexible tube is slidable with respect to at least one of the conduits when the conduits are pivoted with respect to each other.

30. The valve of claim 28 wherein the flexible tube extends into a passageway of at least one of the fluid conduits and is sealed against the interior of the passageway.

31. The valve of claim 30 comprising a sliding seal for sealing the flexible tube to the passageway.

32. The valve of claim 31 wherein the seal is an annular ring.

33. The valve of claim 28 comprising a seat against which the baffle seats and blocks the flow of fluid.

34. The valve of claim 28 wherein the operating element is located in the passageway.

35. The valve of claim 34 comprising a barrier in a passageway of the second conduit for forcing the operating element to separate the baffle from the seat when the conduits are pivoted.

36. A fluid valve comprising:

a first fluid conduit;

a second fluid conduit;

a fluid passageway through the first and second conduits having a central axis;

a mutual pivot point, offset from said axis, at which the first and second fluid conduits are pivotably connected to each other;

a baffle within the fluid passageway in the first fluid conduit for varying the amount of fluid flow through the passageway; and an operating element in communication between the second conduit and the baffle so that pivoting of the conduits with respect to each other moves the baffle so as to vary the amount of fluid flow through the passageway.

37. The valve of claim 36 also comprising a flexible tube between the conduits.

38. The valve of claim 37 wherein the flexible tube is slidable with respect to at least one of the conduits when the conduits are pivoted.

39. The valve of claim 36 comprising a flexible tube extending from one of the conduits into and in sealed sliding relation with the passageway in the other conduit as the conduits are pivoted.

40. The valve of claim 37 wherein the flexible tube comprises a flexible thin walled tube.

41. The valve of claim 37 wherein the flexible tube is elongated.

42. A fluid valve comprising:

a first fluid conduit;

a second fluid conduit sealedly connected to the first fluid conduit;

a passageway through the first and second fluid conduits;

a baffle within the fluid passageway of the first fluid conduit for varying the amount of fluid flow through the passageway;

an operating rod in communication between the baffle and the second fluid conduit; and a mutual pivot point offset from the operating rod at which the fluid conduits are pivotally connected to each other, pivoting of the conduits causing the operating rod to move the baffle so as to vary the amount of fluid flow through the passageway.

43. The valve of claim 42 wherein the operating rod is located within the passageway.

44. The valve of claim 42 wherein the axis is offset from the passageway.

45. The valve of claim 42 comprising a barrier within the passageway of the second conduit and wherein the operating rod is within the fluid passageway and in communication with the barrier, pivoting of the conduits relative to each other causing the barrier to move the rod and the baffle.

46. The valve of claim 45 wherein the rod is movable relative to the baffle.

47. The valve of claim 45 wherein the rod is movable relative to the barrier.

48. The valve of claim 45 wherein the barrier comprises a surface extending substantially transverse to the operating rod.

49. The valve of claim 48 wherein the surface redirects the direction of fluid flowing through the conduits.

50. The valve of claim 49 wherein the operating element is located in the passageway.

51. A fluid valve comprising:

an inlet section having an inlet connection to a source of fluid under pressure;

an outlet section having an outlet;

a fluid passageway through the inlet and outlet sections from the inlet to the outlet through the sealed connection;

the inlet and outlet sections being pivotable towards and away from each other;

a slidable and sealed connection along the passageway between the inlet and outlet sections;

a baffle chamber having a baffle seat disposed within the fluid passageway of the inlet section;

a baffle within the baffle chamber biased towards the seat by the fluid pressure, the baffle substantially blocking fluid flow when resting against the seat but allowing fluid flow when moved away from the seat; and an operating element in communication with the outlet section and with the baffle so that when the inlet and outlet sections are moved towards each other the operating element is moved and separates the baffle from the seat.

52. The valve of claim 51 wherein the slidable and sealed connection comprises a portion of the inlet section which extends into the outlet section.

53. The valve of claim 51 wherein the extending portion is a nozzle.

54. The valve of claim 51 wherein the slidable sealed connection between the inlet and outlet sections comprises a flexible tube extending from one of the sections to the other.

55. The valve of claim 54 comprising a sliding seal between the tube and one of the sections so that when the conduits are pivoted with respect to each other the flexible tube flexes and slides against that section maintaining the seal.

56. The valve of claim 54 wherein the flexible tube extends into the fluid passageway in the other section and seals against the inner boundary of the passageway.

* * * * *

UNITED STATES PATENT AND TRADEMARK OFFICE

CERTIFICATE OF CORRECTION

PATENT NO. : 4,958,803

DATED : September 25, 1990

INVENTOR(S) : Gilmore H. Chappell

It is certified that error appears in the above-identified patent and that said Letters Patent is hereby corrected as shown below:

ON TITLE PAGE:

[63] Related U.S. Aplication Data, delete "Pat. No. 4,361,156" and insert -- abandoned --.

Column 1, line 11, change "entitle" to -- entitled --.

Column 1, lines 23,24, change "now U.S. Pat. No. 4,361,156" to -- , now abandoned --.

Column 1, line 63, change "diskshaped" to -- disk-shaped --.

Column 13, line 2, after "nozzle" insert a period.

Column 13, line 3, after "to" delete the comma.

Signed and Sealed this

Twelfth Day of May, 1992

*Attest:*

DOUGLAS B. COMER

*Attesting Officer*

*Acting Commissioner of Patents and Trademarks*